US007746245B2

(12) United States Patent
Park et al.

(10) Patent No.: US 7,746,245 B2
(45) Date of Patent: Jun. 29, 2010

(54) INTEGRATED REMOTE CONTROL SYSTEM

(75) Inventors: Ji-Hyun Park, Seoul (KR); Kyong-Joon Chun, Seoul (KR); Nak-Koo Kim, Seongnam-si (KR)

(73) Assignee: Samsung Electronics Co., Ltd (KR)

( * ) Notice: Subject to any disclaimer, the term of this patent is extended or adjusted under 35 U.S.C. 154(b) by 1060 days.

(21) Appl. No.: 11/416,587

(22) Filed: May 3, 2006

(65) Prior Publication Data

US 2006/0267741 A1 Nov. 30, 2006

(30) Foreign Application Priority Data

May 24, 2005 (KR) ..... 10-2005-0043726

(51) Int. Cl.
*G08C 19/00* (2006.01)

(52) U.S. Cl. ..... 340/825.69; 340/825.72; 348/734

(58) Field of Classification Search ..... 340/825.69, 340/825.72; 345/717; 348/734; 235/462
See application file for complete search history.

(56) References Cited

U.S. PATENT DOCUMENTS

| | | | | |
|---|---|---|---|---|
| 5,081,534 | A * | 1/1992 | Geiger et al. | 348/734 |
| 5,418,527 | A | 5/1995 | Yashiro | |
| 5,519,457 | A * | 5/1996 | Nishigaki et al. | 340/825.24 |
| 5,815,297 | A * | 9/1998 | Ciciora | 398/112 |
| 6,219,164 | B1 * | 4/2001 | Morgaine | 398/107 |
| 6,498,567 | B1 * | 12/2002 | Grefenstette et al. | 340/825.62 |
| 6,529,680 | B1 * | 3/2003 | Broberg | 386/83 |
| 6,549,719 | B2 * | 4/2003 | Mankovitz | 386/83 |
| 6,636,157 | B1 * | 10/2003 | Sato | 340/825.22 |
| 6,774,813 | B2 * | 8/2004 | van Ee et al. | 340/825.69 |

FOREIGN PATENT DOCUMENTS

| | | |
|---|---|---|
| DE | 19534883 | 4/1996 |
| EP | 0 354 459 | 8/1989 |
| WO | WO 00/70578 | 11/2000 |
| WO | WO 01/95283 | 12/2001 |

* cited by examiner

*Primary Examiner*—Brian A Zimmerman
*Assistant Examiner*—Nam V Nguyen
(74) *Attorney, Agent, or Firm*—The Farrell Law Firm, LLP

(57) ABSTRACT

An integrated remote control system capable of integrally remote-controlling a plurality of electronic devices is provided. The integrated remote control system includes an integrated remote controller for generating a radio control signal for each electronic device and transmitting the radio control signal through one infrared channel such that a plurality of electronic devices can be integrally remote-controlled, a remote control signal converting device for receiving a radio control signal controlling a predetermined electronic device in the integrated remote controller and transmitting the received radio control signal by inserting infrared channel data for the predetermined electronic device into the received radio control signal, and a re-transmitter for receiving the radio control signal including the infrared channel data from the remote control signal converting device, generating an infrared channel according to the infrared channel data, and re-transmitting the radio control signal to the predetermined electronic device through the infrared channel.

32 Claims, 7 Drawing Sheets

INTEGRATED REMOTE CONTROL SYSTEM

PRIORITY

This application claims priority to an application entitled "Integrated Remote Control System" filed in the Korean Intellectual Property Office on May 24, 2005 and assigned Ser. No. 2005-43726, the contents of which are incorporated herein by reference.

BACKGROUND OF THE INVENTION

1. Field of the Invention

The present invention relates to an integrated remote control system capable of remote-controlling a plurality of electronic devices.

2. Description of the Related Art

FIG. 1 illustrates a perspective view of conventional integrated remote controllers.

A user must perform several steps in order to view a digital video disk (DVD) by means of the conventional integrated remote controller shown in FIG. 1. First, the user selects a mode of the integrated remote controller as a television (TV) mode by pressing several times on a "MODE" or a device selecting button. In this state, if the user presses a power-on button, the TV is turned on. Then, the user sets the external input of the television as input for a DVD by pressing several times on a "TV/VIDEO" button. Thereafter, the user selects various setting values of the TV, such as an aspect ratio a sound effect mode, etc., by pressing a "MENU" button and changes the mode of the integrated remote controller to a DVD "MODE" by pressing several times on the "MODE" or the device selecting button. Then, the user turns on the DVD player by pressing a power-on button and then views a DVD by pressing a "PLAY" button.

As described above, the user not only must select a desired electronic device using a device selecting button every times, but also must use several remote controllers as shown in a case wherein a user must turn on the TV in a TV mode, switch the TV mode into a DVD mode so as to turn on the DVD, and then press a "PLAY" button of the DVD player when the user intends to view DVD or cable broadcasting.

In addition, since the conventional integrated remote controller must include modules for generating different infrared channels according to electronic devices in order to remote-control the electronic devices, the costs of manufacturing the conventional integrated remote controller increase. In addition, since the conventional integrated remote controller is manufactured with all infrared channel data according to electronic devices, it is impossible to update the infrared channel data with respect to newly introduced electronic devices. In addition, a remote controller must have a multi-brand remote control (MBR) function embedded in the remote controller in order to remotely control electronic devices of several manufacturing companies, and a user must personally set items for a remote control operation according to electronic devices, or manufacturing companies in order to register electronic devices of other manufacturing companies.

A network remote control system based on a perfect home network system must transmit a remote control signal by connecting all electronic devices to a network, and all electronic devices must include a network module using the same home network protocol. In addition, a user must purchase a high-priced electronic device supporting a home network function, and each manufacturing company constructs a home network system according to its own standard. Accordingly, the manufacturing companies have no method for incorporating their electronic devices with electronic devices of different companies.

In addition, the conventional integrated remote control systems typically allow a user to set an external input of a television or a set-top box using several remote controllers. For example, the user sets external input #1 of the television when viewing a DVD, and the user re-sets external input #2 of the television when viewing cable broadcasting.

Further, when a user uses the conventional remote controller, if there are obstacles in front of an electronic device, a radio control signal is not transmitted to the electronic device, and the user must operate the conventional remote controller once more. In addition, even when a user views cable broadcasting after viewing a DVD, a DVD player is continuously turned on, so that unnecessary power consumption occurs.

SUMMARY OF THE INVENTION

Accordingly, the present invention has been made to solve the above-mentioned problems occurring in the prior art, and an object of the present invention is to provide an integrated remote control system which integrally remotes controls a plurality of electronic devices through one manipulation.

Another object of the present invention is to provide an integrated remote control system which automatically sets an external input whenever remotely controlled electronic devices are changed.

A further object of the present invention is to provide an integrated remote control system which inserts data enabling a remote control operation over a new electronic device to a remote controller using a network.

An additional object of the present invention is to provide an integrated remote control system which provides a remote controller with a touch screen as an input module performing a remote control operation.

A still further object of the present invention is to provide an integrated remote control system which can determine an operation state of an electronic device to be remotely controlled and automatically re-transmit a radio control signal, which is not transmitted.

Another object of the present invention is to provide an integrated remote control system which automatically turns off an electronic device if the electronic device is not used due to an external input switching operation.

To accomplish the above objects, there is provided an integrated remote control system including an integrated remote controller for generating a radio control signal for each electronic device and transmitting the radio control signal through one infrared channel such that a plurality of electronic devices can be integrally remote-controlled, a remote control signal converting device for receiving a radio control signal controlling a predetermined electronic device in the integrated remote controller and transmitting the received radio control signal by inserting infrared channel data for the predetermined electronic device into the received radio control signal, and a re-transmitter for receiving the radio control signal including the infrared channel data from the remote control signal converting device, generating an infrared channel according to the infrared channel data, and re-transmitting the radio control signal to the predetermined electronic device through the infrared channel.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1:
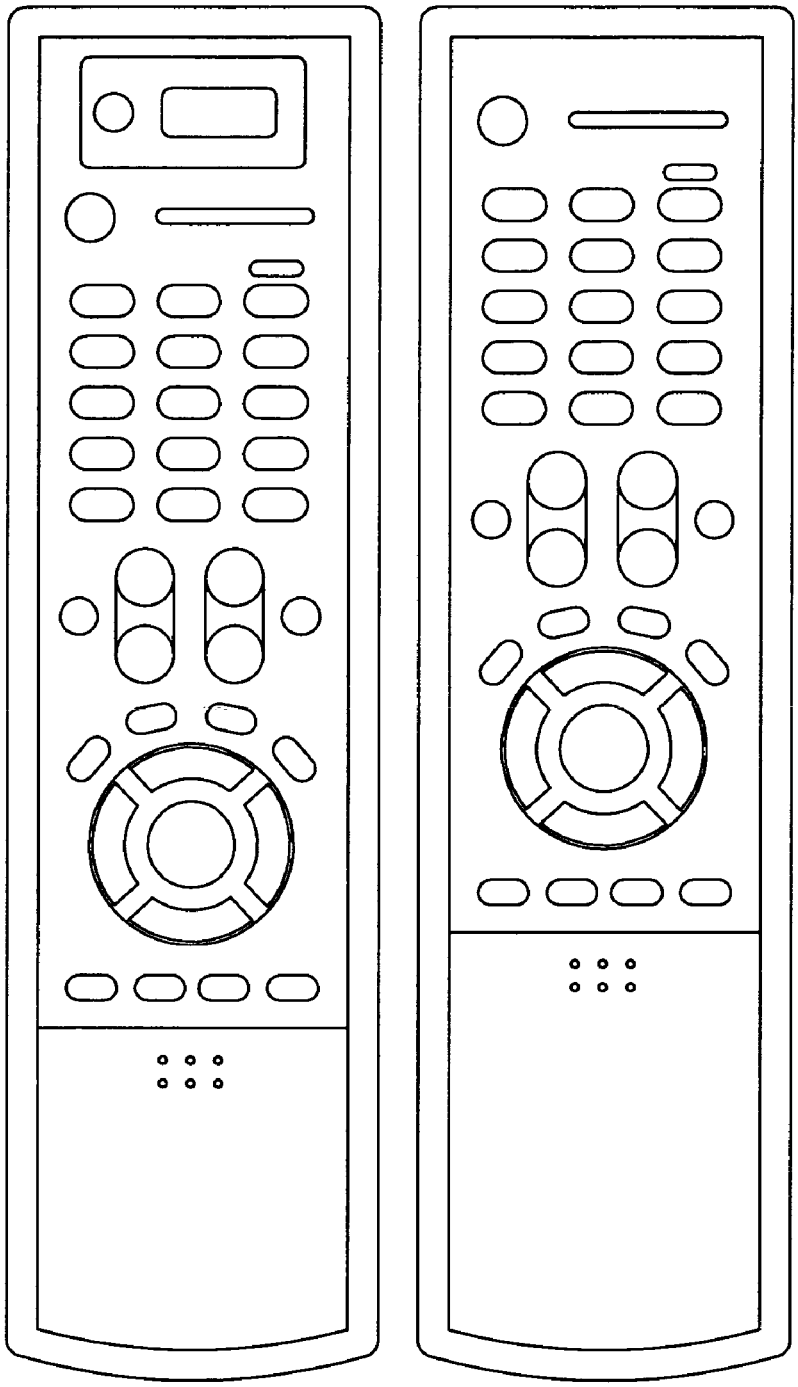
FIG.1 (PRIOR ART)
FIG. 1 is a perspective view illustrating conventional integrated remote controllers.

Hereinafter, a preferred embodiment of the present invention will be described in detail with reference to the accompanying drawings. Note that the same or similar components in drawings are designated by the same reference numerals as far as possible although they are shown in different drawings. In the following description of the present invention, a detailed description of known functions and configurations incorporated herein will be omitted when it may make the subject matter of the present invention unclear.

Figure 2:
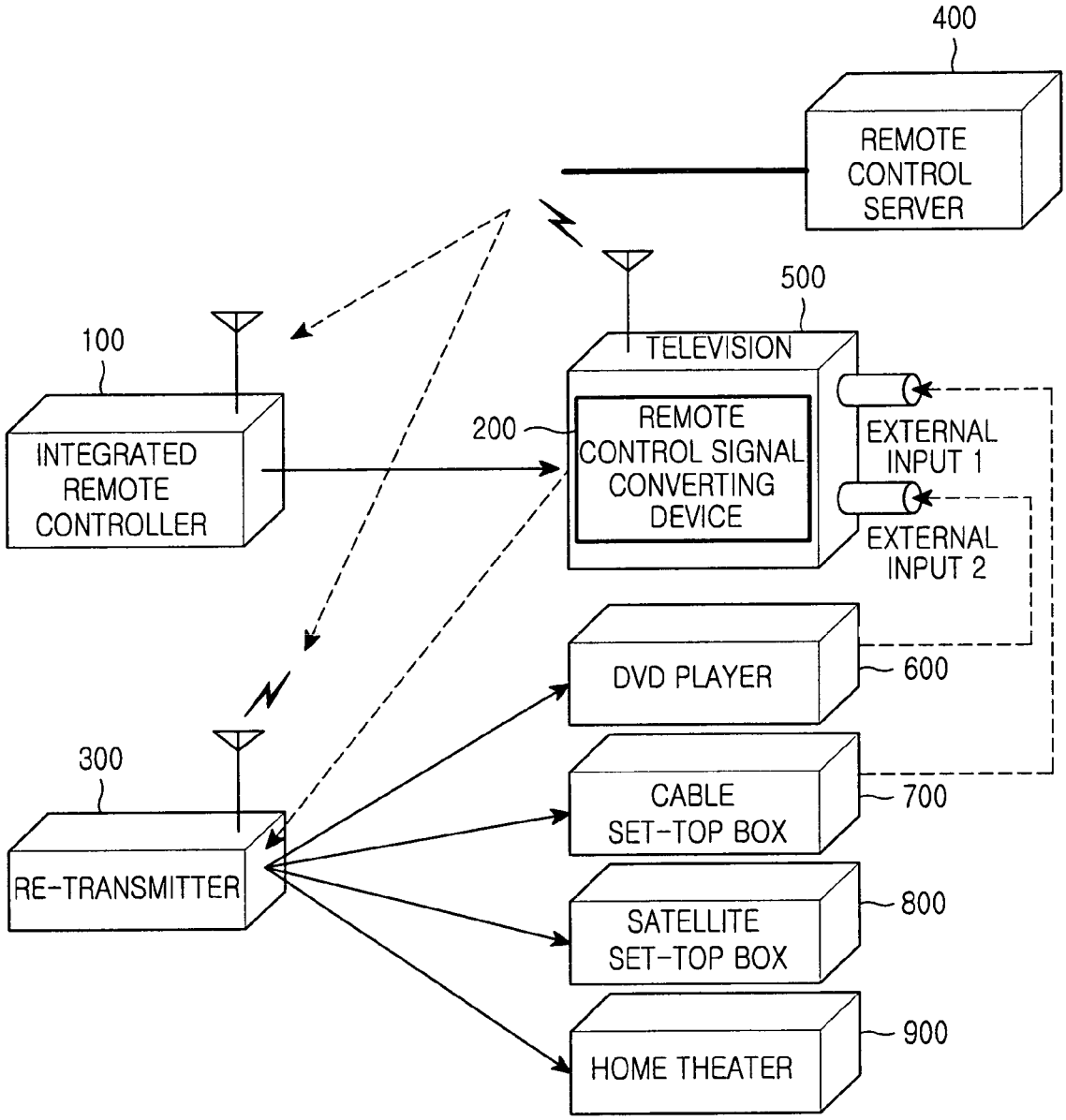
FIG. 2 is a block diagram illustrating the structure of an integrated remote control system according to a preferred embodiment of the present invention.

FIG. 2 is a block diagram illustrating the structure of an integrated remote control system according to the present invention.

An integrated remote controller 100 generates radio control signals for plural electronic devices and transmits the radio control signals through a single infrared channel to a remote control signal converting device 200 such that the electronic devices can be integrally remote-controlled. According to the present invention, the electronic devices may be a television 500, a DVD player 600, a cable set-top box 700, a satellite set-top box 800, and a home theater 900.

The remote control signal converting device 200 receives a radio control signal for a predetermined electronic device from the integrated remote controller 100 and transmits the radio control signal to a re-transmitter 300 by inserting infrared channel data for the predetermined electronic device into the received radio control signal. Although the remote control signal converting device 200 is embedded in the television 500 according to an embodiment of the present invention, the remote control signal converting device 200 may be embedded in devices other than the television 500, or may be independently constructed.

The re-transmitter 300 receives a radio control signal including infrared channel data from the remote control signal converting device 200, creates an infrared channel according to the infrared channel data, and re-transmits the radio control signal to the predetermined electronic device through the created infrared channel.

A remote control server 400 stores input module data used for driving a remote control operation over each electronic device and infrared channel data for each electronic device. In the meantime, the user may set a macro command created by integrating at least two remote control commands formed using a device (e.g., a computer) which can be accessed the remote control server 400, or remote control commands frequently used by a user so as to provide the macro command to the remote control service 400. Then, the remote control server 400 generates an input module data used for operating the macro command so as to transmit the input module data to the integrated remote controller 100.

In more detailed description about the macro command, if the integrated remote controller 100 receives input module data used for executing the macro command from the remote control server 400, the integrated remote controller 100 designates a button according to the input module data, or creates a new button through a touch screen scheme. Once the user presses the button, the integrated remote controller 100 generates a radio control signal for executing the macro command according to the pressed button so as to transmit the radio control signal to the remote control converting device 200.

For example, a user may access the remote control server 400 using a computer and set a macro command created by integrating a command of turning on a DVD player and a command of playing the DVD player. The remote control server 400 generates input module data for executing the set macro command so as to transmit the input module data to the integrated remote controller 100. The input module data is used for establishing or creating an input module for executing the macro command. In the above-described example of the macro command for the DVD player, contents of "set an input module for executing a macro command as a DVD play button" may be the input module data. In other words, if a user presses the DVD play button in the integrated remote controller 100, the integrated remote controller 100 generates a radio control signal used for executing a macro command created by integrating a command of turning on the DVD player with a command of playing the DVD player, and transmits the radio control signal to the remote control signal converting device 200.

Hereinafter, a description about the integrated remote controller 100, the remote control signal converting device 200, and the re-transmitter 300 included in the integrated remote control system will be described in more detail with respect to FIGS. 3 to 8.

Figure 3:
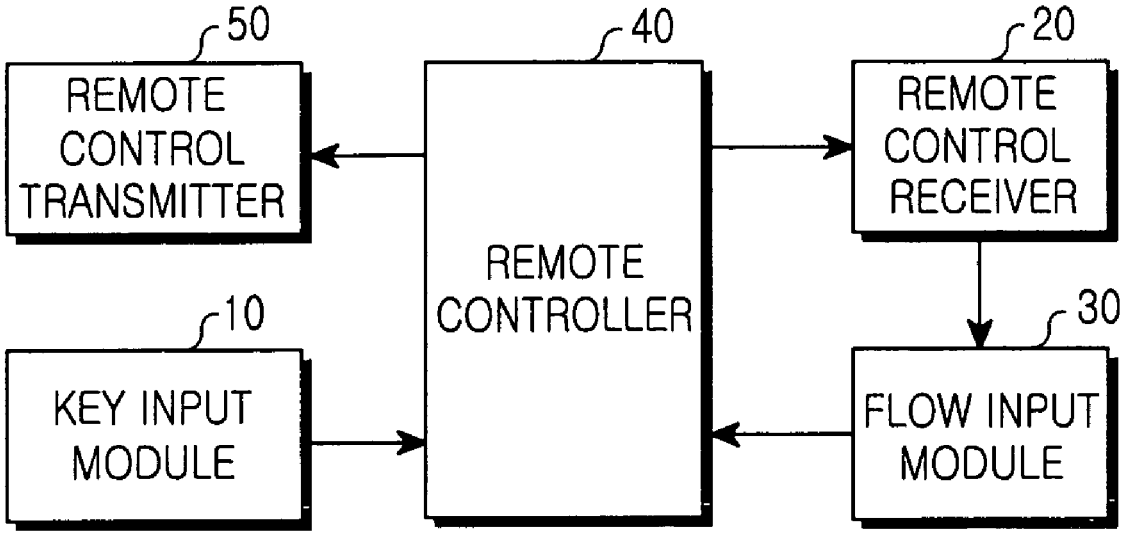
FIG. 3 is a block diagram illustrating the structure of an integrated remote controller according to a preferred embodiment of the present invention.

FIG. 3 is a block diagram illustrating the structure of the integrated remote controller 100 according to the present invention.

A key input module 10 of the integrated remote controller 100 receives a key input used for remote-controlling plural electronic devices from a user and provides the key input to a remote controller 40. Preferably, the key input module 10 is a fixture input module including rubber buttons. A remote control receiver 20 receives input module data for executing an additional remote control operation from the remote control server 400 so as to output the input module data to a flow input module 30. The flow input module 30 creates an additional input module based on the input module data received from the remote control receiver 20 according to the control of the remote controller 40 so as to provide the additional input module to the touch screen. The touch screen has easy scalability such that each electronic device is modified and displayed with respect to a new additional input module. If the remote controller 40 receives input for remote-controlling a predetermined electronic device through the key input module 10 or the flow input module 30, the remote controller 40 generates a radio control signal for the predetermined electronic device and outputs the radio control signal to the remote control transmitter 50. The remote control transmitter 50 transmits the radio control signal for the predetermined electronic device generated in the remote controller 40 through one infrared channel. A perspective view showing the integrated remote controller 100 having the above-described structure is FIG. 4.

Figure 4:
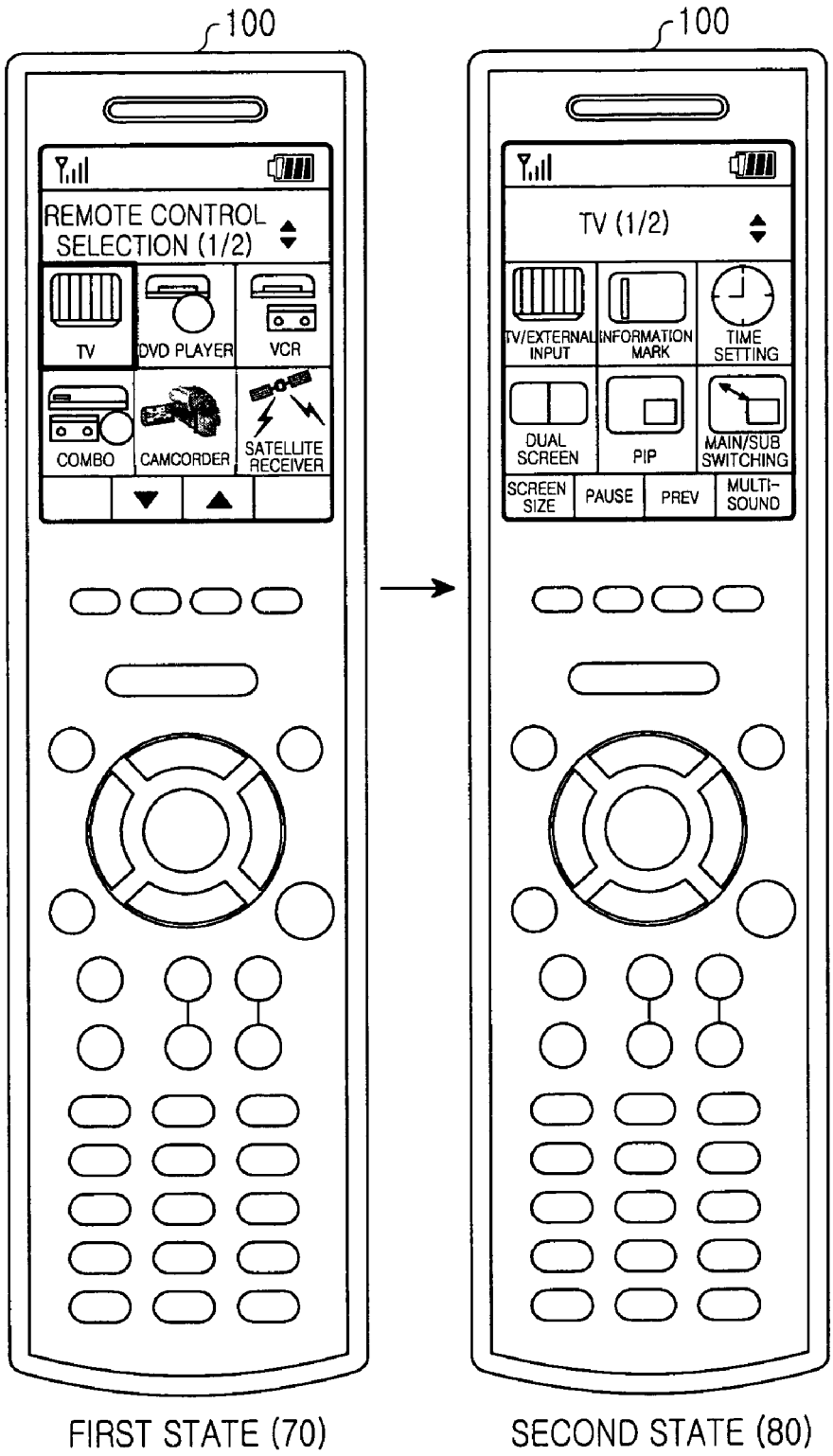
FIG. 4 is a perspective view illustrating an integrated remote controller according to a preferred embodiment of the present invention.

Referring to FIG. 4, in the first state 70 in which the integrated remote controller 100 displays remote-controllable input module for each electronic device as icons on a touch screen, various icons representing TV, DVD PLAYER, VCR, COMBO, CAMCORDER, SATELLITE RECEIVER are displayed on the touch screen. The user can select one icon which represents an electronic device to be remote-controlled, from among the displayed icons. As soon as the user selects one icon, the remote controller displays menu items for remote control of the electronic device corresponding to the selected icon. For example, when the icon of TV has been selected, menu items for remote control of TV are displayed as shown in the second state 80. The user can select and input one of the displayed menu items for the remote control of TV. Then, the remote controller 100 transmits a control radio signal corresponding to the user's input.

Figure 5:
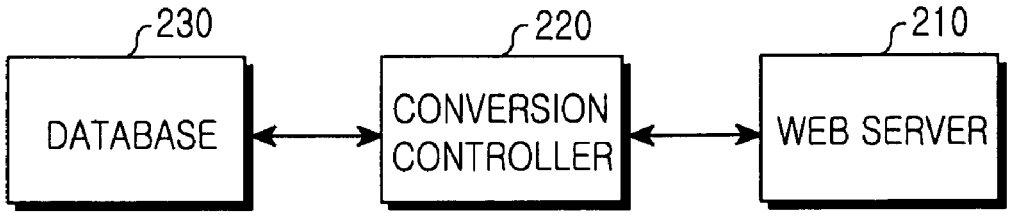
FIG. 5 is a block diagram illustrating the structure of a remote control signal converting device according to a preferred embodiment of the present invention.

FIG. 5 is a block diagram illustrating the structure of the remote control signal converting device 200 according to the present invention.

A web server 210 of the remote control signal converting device 200 provides a web page for receiving information including a model name or a model number of an electronic device from a user. Accordingly, a user can input information including model names or model numbers of the television 500, the DVD player 600, the cable set-top box 700, the satellite set-top box 800, and the home theater 900 by accessing the web page through the web browser of a computer. The web server 210 accesses the remote control server 400 according to the control of a conversion controller 220 in order to receive infrared channel data for an electronic device corresponding to a model input through the web page. For example, the web server 210 accesses the remote control server 400 so as to receive infrared channel data used for remote controlling the DVD player 600 if the electronic device corresponding to the model input through the web page is the DVD player 600. A database 230 stores infrared channel data received through the web server 210 according to the control of the conversion controller 220.

The conversion controller 220 extracts infrared channel data, which is used for an electronic device remote-controlled by a radio control signal received from the integrated remote controller 100, out of the database 230 and inserts the infrared channel data into the radio control signal so as to transmit the radio control signal to the re-transmitter 300. For example, if the conversion controller 220 receives a radio control signal used for remote-controlling the DVD player 600 from the integrated remote controller 100, the conversion controller 220 extracts infrared channel data for the DVD player 600 from the database 230 and inserts the infrared channel data into the radio control signal, thereby transmitting the radio control signal to the re-transmitter 300.

The conversion controller 220 may use infrared communication, a wireless network, or a wired network in order to transmit a radio control signal including infrared channel data to the re-transmitter 300. The wireless network may be realized as a wireless local area (WLAN) network, or a network constructed through Bluetooth communication, and the wired network may be realized as a network constructed through power line communication (PLC) or IEEE 1394 communication. The IEEE 1394 communication (IEEE 1394 high capacity serial bus; Fire Wire) is one of schemes for connection and communication between a Personal Computer (PC) and peripheral devices and can be expressed as a serial bus existing between a microprocessor of a PC and at least one peripheral device. According to the IEEE 1394 communication, it is possible to mount maximum 63 peripheral devices to one PC by connection of one plug with a socket, and each connected device can transmit data at a speed of maximum 400 Mbps.

In addition, if the remote control signal converting device 200 is connected to electronic devices in a network, the conversion controller 220 may transmit a radio control signal including the infrared channel data to the electronic devices through the network.

When the remote control signal converting device 200 is embedded in the television 500 as shown in FIG. 2, and when a user inputs model names or model numbers of electronic devices through a web browser by accessing a web page of the web server, the user can input a number of an external input port if the electronic devices corresponding to the input model names or the input models are connected to external input ports of the television 500. The user can input setting values of the TV 500 such as an aspect ratio, a sound effect mode, etc., whenever external input is set according to electronic devices connected to an the external input ports of the TV 500, and the input information will be described below.

If a user presses a DVD player selection button included in the key input module of the integrated remote controller 100 in order to view a DVD, the remote controller 40 automatically sets the mode of the integrated remote controller 100 as a DVD player mode. In addition, the remote controller 40 generates a radio control signal for remote-controlling the DVD player 600 and transmits the radio control signal to the remote control signal converting device 200 through the remote control transmitter 50.

The conversion controller 220 receives a radio control signal for remote-controlling the DVD player 600 from the integrated remote controller 100 and determines an external input port of the TV 500 connected to the DVD player 600. If it is determined that the DVD player 600 is connected to the second external input port of the TV 500, the conversion controller 220 sets the number for an external input port of the TV 500 as #2. In addition, the conversion controller 220 determines a setting value for the TV 500 corresponding to the external input #2 as a value previously input by the user. In addition, the conversion controller 220 extracts infrared channel data for the DVD player 600 from the database 230 and inserts the infrared channel data into the received radio control signal, thereby transmitting the radio control signal to the re-transmitter 300.

Figure 6:
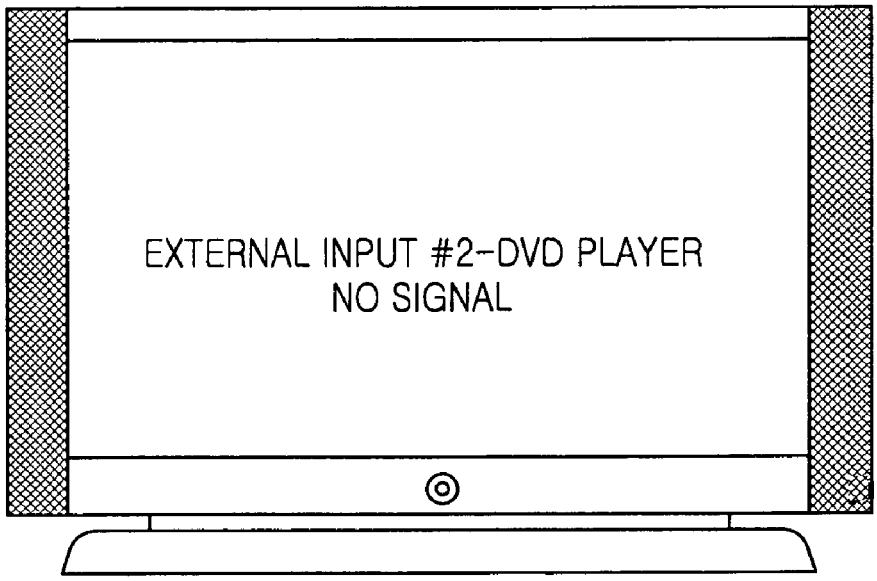
FIGS. 6 and 7 are views illustrating screen examples according to a preferred embodiment of the present invention.

After external input #2 of the TV 500 is set as described above, the conversion module 220 determines if the signal of the DVD player 600 is input through external input #2 during a predetermined time interval. The predetermined time interval is a value which can be set by a user. If the signal of the DVD player 600 is not input through external input # 2 during a predetermined time interval, the conversion controller 220 performs a control operation such that a statement reporting that "the signal of the DVD player 600 is not input" is expressed on the screen of the TV 500 as shown in FIG. 6. In this case, it may be determined that the re-transmitter 300 having received a radio control signal including infrared channel data for the DVD player 600 fails to re-transmit the radio control signal because a person passes by the DVD player 600 during the re-transmission of the radio control signal for the DVD player 600. Accordingly, since the DVD player 600 does not receive the radio control signal, no signal is output through external input #2 of the TV 500.

Hereinafter, it is assumed that a signal transmitted from the integrated remote controller 100 is a radio control signal for executing a macro command. For example, the transmitted signal may be a radio control signal for executing a macro command created by integrating a command of turning on the DVD player and a command of playing the DVD player. The re-transmitter 300 having received the radio control signal for executing the macro command through the remote control signal converting module 200 re-transmits the radio control signal for executing the first command of turning on the DVD player of the macro command to the DVD player 600. If the re-transmitter fails to re-transmit the radio control signal for executing the first command because a person passes by the DVD player 600 during the re-transmission of the radio control signal, the DVD player 600 is not turned on because the radio control signal is not received. Thereafter, although the DVD player 600 receives a radio control signal for executing the second command of playing the DVD player of the macro command from the re-transmitter 300, the DVD player 600 is not played because the DVD player 600 is not turned on.

Figure 7:
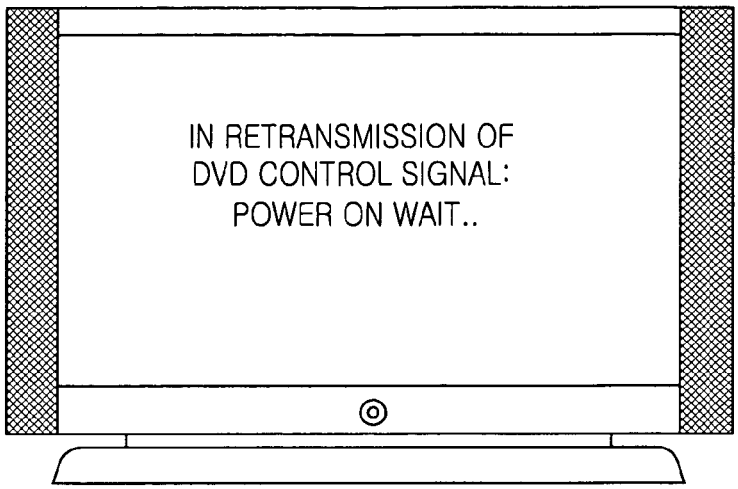

In the above cases, the conversion controller 220 transmits a signal requesting a radio control signal for the DVD player 600 to be re-transmitted to the re-transmitter 300 and performs a control operation such that a statement reporting that a radio control signal for the DVD player 600 is in re-transmission is expressed on the screen of the TV 500 as shown in FIG. 7. Then, the re-transmitter 300 responds to the received re-transmission request signal for the radio control signal so as to re-transmit the radio control signal for the DVD player 600 to the remote control signal converting device 200. In the meantime, the conversion controller 220 determines if the signal of the DVD player 600 is input again through external input #2 during a predetermined time interval. The conversion controller 220 repeatedly performs the above-described operation according to the determination result.

As described above, the signal of the DVD player is checked through an external input so that the DVD player 600 performs an operation initially requested by a user and sequentially performs its operations even when it is remotely controlled under a macro command. Accordingly, a user can view a DVD through only single button manipulation as described above according to the present invention even though transmission of a radio control signal for the DVD player may have failed.

If the conversion controller 220 receives a radio control signal for a new electronic device from the integrated remote controller 100, the conversion controller 220 determines the external input port of the TV 500 set for the new electronic device. For example, it is assumed that external input #2 of the TV 500 is set, in which the DVD player 600 is connected to the TV 500. In other words, it is assumed that a user is viewing a DVD. In this state, if the user presses a cable broadcasting selection button included in the key input module 10 of the integrated remote controller 100 because the user wants to view cable broadcasting, the remote controller 40 automatically sets a mode of the integrated remote controller 100 as a mode for the cable broadcasting. Then, the remote controller 40 generates a radio control signal for remote-controlling the cable set-top box 700 so as to transmit the radio control signal to the remote control signal converting device 200 through the remote control transmitter 50.

The conversion controller 220 determines an external input port of the TV 500 set for the cable set-top box 700 by receiving a radio control signal for remote-controlling the cable set-top box 700 from the integrated remote controller 100. If it is determined that the first external input port of the TV 500 is set for the cable set-top box 700, the conversion controller 220 changes the external input of the TV 500 to external input # 1. In addition, the conversion controller 220 determines a setting value for the TV 500 corresponding to external input #1 as a setting value previously input by the user.

Then, the conversion controller 220 transmits a signal requesting pause of an operation of the DVD player 600 relating to external input # 2 of the TV 500 to the re-transmitter 300 because a user may want to view the DVD again after viewing cable broadcasting for a moment. Accordingly, the re-transmitter 300 transmits a radio control signal for temporarily stopping the operation of the DVD player 600 to the remote control signal converting device 200. Therefore, the operation of the DVD player 600 relating to external input # 2 of the TV 500 is temporarily stopped, and the conversion controller 220 determines if the radio control signal for the DVD player 600 is received from the integrated remote controller 100 during a predetermined time interval. The predetermined time interval may be set by the user.

If it is determined that the radio control signal for the DVD player 600 is not received, the conversion controller 220 transmits a signal requesting to turn the temporarily stopped DVD player 600 off to the re-transmitter 300. Therefore, the re-transmitter 300 transmits a radio control signal for turning the DVD player 600 off to the remote control signal converting device 200.

In contrast, if the radio control signal for the DVD player 600 is received, the conversion controller 220 changes external input #1 of the TV 500 to external number # 2. In addition, the conversion controller 220 transmits a request signal of re-playing the temporarily stopped DVD player 600 to the re-transmitter 300. Therefore, the re-transmitter 300 transmits a radio control signal for re-playing the DVD player 600 to the remote control signal converting device 200. Then, the conversion controller 220 determines if the radio control signal for the cable set-top box 700 is received from the integrated remote controller 100 during a predetermined time interval as described above. The conversion controller 220 repeatedly performs the above-described operation according to the determination result.

Figure 8:
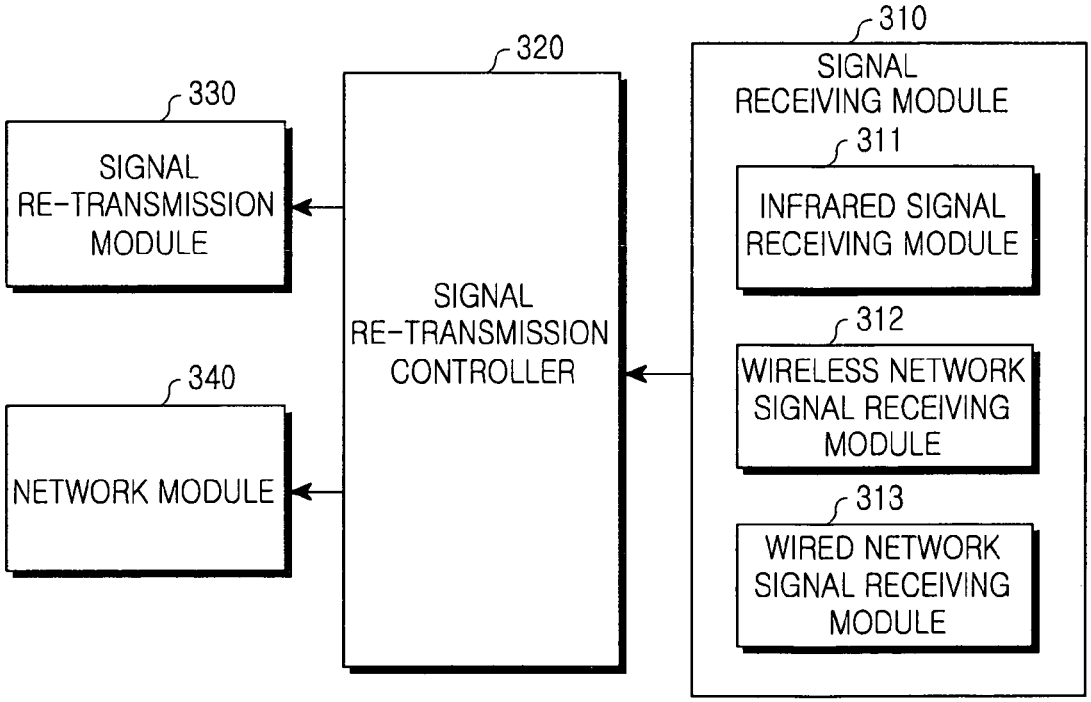
FIG. 8 is a block diagram illustrating the structure of a re-transmitter according to a preferred embodiment of the present invention.

FIG. 8 is a block diagram illustrating the structure of the re-transmitter 300 according to the present invention.

A signal receiving module 310 of the re-transmitter 300 receives a radio control signal including the infrared channel data from the remote control signal converting device 200 so as to output the radio control signal to a signal re-transmission controller 320. If the radio control signal including infrared channel data, which is output from the signal receiving module 310, is a signal for executing a macro command, the signal re-transmission controller 320 sequentially generates radio control signals for executing the macro command and outputs the radio control signals to a signal re-transmission module 330. The signal re-transmission module 330 generates an infrared channel according to infrared channel data included in the radio control signal output from the signal re-transmission controller 320 and re-transmits the radio control signal to a destination electronic device through the infrared channel. The signal re-transmission module 330 includes various sensors in order to create infrared channels for remote-controlling electronic devices.

The remote control signal converting device 200 transmits a radio control signal including the infrared channel data to the re-transmitter 300 through infrared communication, a wireless network, or a wired network. To this end, the signal receiving module 310 includes an infrared signal receiving module 311, a wireless network signal receiving module 312, and a wired network signal receiving module 313.

A network module 340 transmits/receives a radio control signal including the infrared channel data to/from another re-transmitter having the same structure as the re-transmitter 300 under the control of the signal re-transmission controller 320. If an electronic device, which is to receive the radio control signal having received through the signal receiving module 310, is in a blanket area, the signal re-transmission controller 320 transmits the radio control signal to another re-transmitter in the blanket area through the network module 340. Accordingly, the re-transmitter in the blanket area re-transmits the received radio control signal to a destination electronic device.

Figure 9:
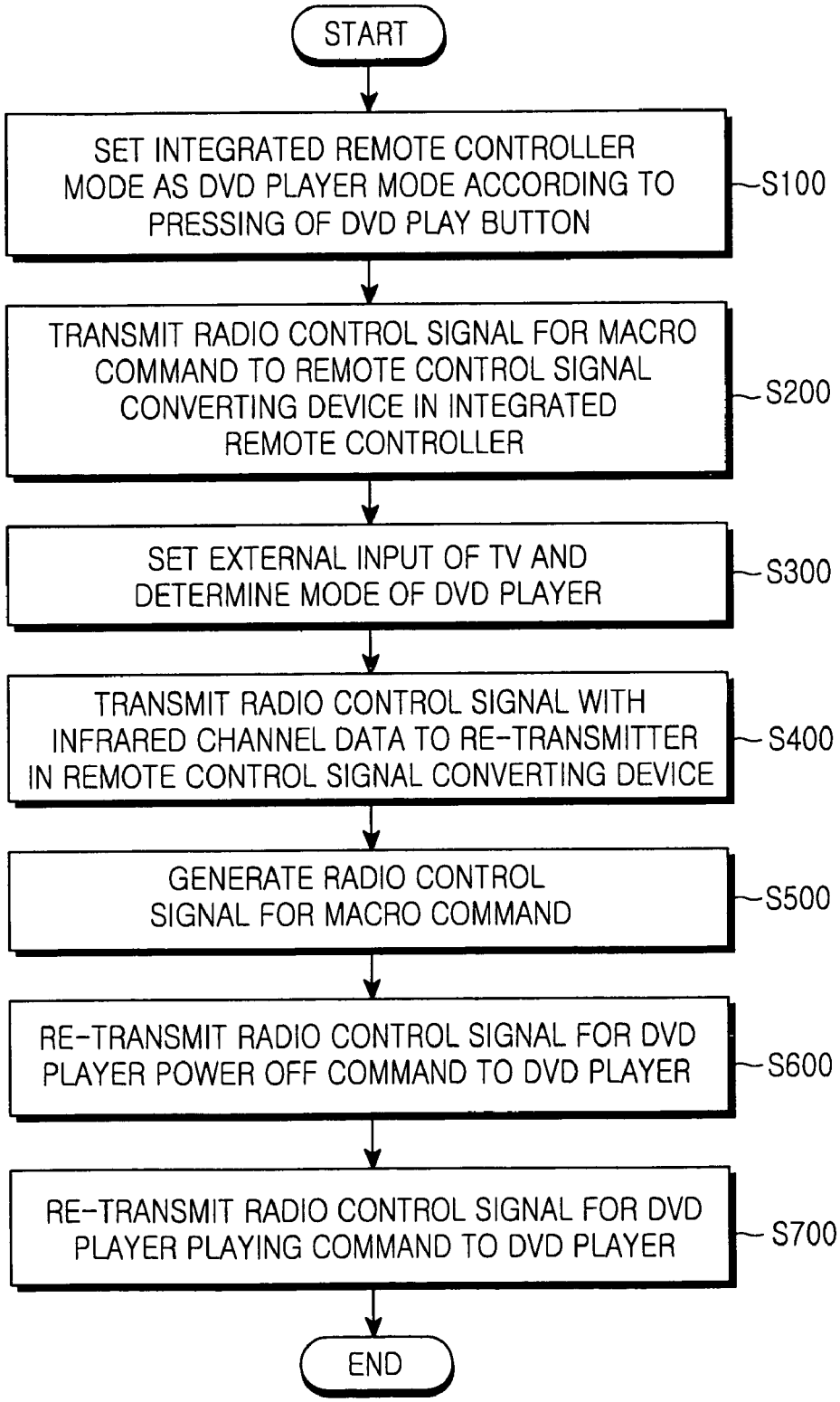
FIG. 9 is a flowchart illustrating a procedure of remotely controlling a DVD player in an integrated remote control system according to a preferred embodiment of the present invention.

Hereinafter, a procedure of controlling a DVD player when a user simply presses a DVD play button included the key input module 10 of the integrated remote controller 100 in the integrated remote control system according to the present invention will be described in more detail with respect to the flowchart of FIG. 9.

If a user presses a DVD play button included in the key input module 10 of the integrated remote controller 100, the remote controller 40 automatically sets a mode of the integrated remote controller 100 as a mode for the DVD player in step S100. In step S200, the remote controller 40 generates radio control signals for executing a macro command created by integrating a command of turning on the DVD player and a command of playing the DVD player so as to transmit the radio control signals to the remote control signal converting device 200.

The conversion controller 220 of the remote control signal converting device 200 having received the radio control signals for executing the macro command sets an external input of the TV 500 according to the number for an external input port set for the DVD player 600. In addition, the conversion controller 220 determines a setting value for the TV 500 corresponding to the external input for the DVD player 600 as a setting value previously input by a user in step S300. In addition, the conversion controller 220 extracts infrared channel data for the DVD player 600 from the database 230, inserts the infrared channel data into the received radio control signal, and then transmits the radio control signal to the re-transmitter 300 in step S400.

Accordingly, the signal receiving module 310 of the re-transmitter 300 receives a radio control signal including the infrared channel data from the remote control signal converting device 200 and outputs the radio control signal to the signal re-transmission controller 320. Since the radio control signal including infrared channel data output from the signal receiving module 310 is used for executing the macro command, the signal re-transmission controller 320 sequentially generates radio control signals for executing the macro command (i.e., a radio control signal for executing a command of turning on the DVD player and a radio control signal for executing a command of playing the DVD player) and outputs the radio control signals to the signal re-transmission module 330 in step S500.

The signal re-transmission module 330 generates an infrared channel according to the infrared channel data and re-transmits the radio control signals sequentially output from the signal re-transmission controller 320 to the DVD player 600 through the generated infrared channel. In other words, the signal re-transmission module 330 receives the radio control signal for executing the command of turning on the DVD player from the signal re-transmission controller 320 so as to re-transmit the radio control signal to the DVD player 600 through the infrared channel in step S600. Accordingly, the DVD player 600 is turned on.

Thereafter, the signal re-transmission module 330 receives the radio control signal for executing the command of playing the DVD player from the signal re-transmission controller 320 and re-transmits the radio control signal to the DVD player 600 through the infrared channel in step S700. Accordingly, the DVD player plays the DVD. Thus, a user can view a DVD by pressing a single button.

As described above, according to the present invention, an integrated remote control system including an integrated remote controller, a remote control signal converting device, and a re-transmitter is provided, so that a user can integrally remote-control all electronic devices through a simple manipulation. Accordingly, convenience of the user in using the electronic devices is increased.

In addition, a macro command is provided, so that a user can execute frequently used remote control commands or fixed commands through manipulation of a single button.

Additionally, data of an integrated remote controller are remotely upgraded through a network, so that it is possible to easily remote-control new electronic devices, and a user can personally upgrade data of an integrated remote controller through a computer.

In addition, an integrated remote controller including a fixture button and a touch screen is provided, so that it is possible to easily add or modify an input module for remote-controlling new electronic devices without additional upgrade of hardware.

Additionally, an integrated remote controller simply makes communication with only a remote control signal converting device, so that it is unnecessary for the integrated remote controller to include modules which create infrared channels used for remote-controlling various electronic devices. Accordingly, it is possible to reduce the costs of manufacturing the integrated remote controller.

Furthermore, an integrated remote control system according to the present invention automatically sets external input whenever a remotely controlled electronic device is changed, so that it is unnecessary for a user to frequently re-set the external input. Therefore, the user enjoys increased convenience.

It is determined if a predetermined signal is input to an external input port connected to a remotely-controlled electronic device, so that it is possible to provide a state of each electronic device to a user. Additionally, it is determined if a predetermined signal is input to an external input port connected to a remotely-controlled electronic device, so that it is possible to exactly remote-control an electronic device by requesting a control signal which is not transmitted. Further, it is determined if a predetermined signal is input to an external input port connected to a remotely-controlled electronic device, so that an unused electronic device is turned off. Accordingly, it is possible to prevent unnecessary power consumption.

While the invention has been shown and described with reference to certain preferred embodiments thereof, it will be understood by those skilled in the art that various changes in form and details may be made therein without departing from the spirit and scope of the invention. Consequently, the scope of the invention should not be limited to the embodiments, but should be defined by the appended claims and equivalents thereof.

What is claimed is:

1. An integrated remote control system comprising:

an integrated remote controller for generating a radio control signal for each of a plurality of electronic devices and transmitting the radio control signal through one infrared channel such that the plurality of electronic devices can be integrally remote-controlled;

a remote control signal converting device for receiving the radio control signal, for controlling a predetermined electronic device in the integrated remote controller and transmitting the received radio control signal by inserting infrared channel data for the predetermined electronic device into the received radio control signal;

a re-transmitter for receiving the radio control signal including the infrared channel data from the remote control signal converting device, generating an infrared channel according to the infrared channel data, and re-transmitting the radio control signal to the predetermined electronic device via the infrared channel; and a remote control server for storing input module data used for driving remote control operations of the plurality electronic devices, wherein, if a user sets a macro command created by integrating at least two remote control commands using a device capable of connecting to the remote control server and provides the macro command to the remote control server, the remote control server generates input module data used for driving the macro command and transmits the input module data to the integrated remote controller.

2. The system as claimed in claim 1, wherein the integrated remote controller comprises:

a key input module for receiving a key input used for remotely controlling the plurality of electronic devices by the user;

a remote control receiving module for receiving input module data used for performing an additional remote control operation from the remote control server;

a flow input module for creating an additional input module based on the input module data received through the remote control receiving module and providing the input module through a touch screen;

a remote controller for generating a radio control signal for the predetermined electronic device if input for remotely controlling the predetermined electronic device is received through the key input module and the flow input module; and a remote control transmitting module for transmitting the radio control signal generated from the remote controller through one infrared channel.

3. The system as claimed in claim 1, wherein the remote control server stores infrared channel data for the electronic devices.

4. The system as claimed in claim 1, wherein the remote control signal converting device further comprises:

a web server for accessing the remote control server in order to receive infrared channel data for an electronic device having a corresponding model name, or a corresponding model number if a user inputs the model number or the model name of the electronic device;

a database for storing infrared channel data received through the web server; and a conversion controller for extracting from the database infrared channel data for the electronic device corresponding to the radio control signal received in the integrated remote controller, inserting the infrared channel data into the radio control signal, and transmitting the radio control signal to the re-transmitter.

5. The system as claimed in claim 4, wherein the conversion controller transmits the radio control signal including the infrared channel data to the re-transmitter through infrared communication.

6. The system as claimed in claim 4, wherein the conversion controller transmits the radio control signal including the infrared channel data to the re-transmitter through a wireless network.

7. The system as claimed in claim 6, wherein the wireless network is constructed based on one of a wireless local area network and Bluetooth communication.

8. The system as claimed in claim 4, wherein the conversion controller transmits the radio control signal including the infrared channel data to the re-transmitter through a wired network.

9. The system as claimed in claim 8, wherein the wired network is constructed based on one of power line communication (PLC) or IEEE 1394 communication.

10. The system as claimed in claim 4, wherein, if the remote control signal converting device is connected to electronic devices via a network, the conversion controller transmits the radio control signal including the infrared channel data to the electronic devices through the network.

11. The system as claimed in claim 4, wherein, if the remote control signal converting device is embedded in a video providing device, the conversion controller receives external input numbers of electronic devices, which are connected to external input ports of the video providing device, from the user.

12. The system as claimed in claim 11, wherein the conversion controller receives from the user setting values for the video providing device according to the electronic devices connected to the external input ports.

13. The system as claimed in claim 11, wherein, if an electronic device corresponding to the radio control signal received from the integrated remote controller is connected to the external input port of the video providing device, the conversion controller sets the external input of the video providing device as an external input number for the electronic device, which corresponds to the radio control signal.

14. The system as claimed in claim 13, wherein the conversion controller determines a setting value of the video providing device corresponding to the set external input as a setting value previously input from the user.

15. The system as claimed in claim 14, wherein, if a signal of the predetermined electronic device is not input through the set external input during a predetermined time interval, the conversion controller transmits a request signal for re-transmission of the radio control signal for the predetermined electronic device to the re-transmitter.

16. The system as claimed in claim 15, wherein, if the re-transmitter receives the request signal for re-transmission of the radio control signal from the remote control signal conversion device, the re-transmitter re-transmits a radio control signal corresponding to the request signal for the re-transmission to the remote control signal converting device.

17. The system as claimed in claim 15, wherein, if the signal of the predetermined electronic device is not input through the set external input during the predetermined time interval, the conversion controller performs a control operation such that a statement representing that the signal of the predetermined electronic device is not input is expressed on a screen of the video providing device.

18. The system as claimed in claim 15, wherein the conversion controller transmits the request signal for the retransmission of the radio control signal and then performs a control operation such that a statement representing that the radio control signal for the predetermined electronic device is in progress is expressed on a screen of the video providing device.

19. The system as claimed in claim 15, wherein, if the conversion controller receives a radio control signal for a new predetermined electronic device connected to an other external input port of the video providing device from the integrated remote controller, the conversion controller changes the external input of the video providing device as an external input number set for the new predetermined electronic device.

20. The system as claimed in claim 19, wherein, if the external input of the video providing device is changed, the conversion controller transmits a request signal for temporarily stopping a predetermined electronic device corresponding to previous external input to the re-transmitter, thereby temporarily stopping an operation of the electronic device corresponding to the previous external input.

21. The system as claimed in claim 20, wherein, if the re-transmitter receives the request signal for temporarily stopping the predetermined electronic device from the remote control signal converting device, the re-transmitter transmits a radio control signal corresponding to the request signal to the remote control signal converting device.

22. The system as claimed in claim 21, wherein the conversion controller transmit a request signal for turning off the stopping electronic device corresponding to the previous external input if a predetermined time interval elapses.

23. The system as claimed in claim 22, wherein, if the re-transmitter receives the request signal for turning off the predetermined electronic device from the remote control signal converting device, the re-transmitter transmits a radio control signal corresponding to the request signal to the remote control signal converting signal.

24. The system as claimed in claim 20, wherein, if the conversion controller receives a radio control signal for the electronic device corresponding to the previous external input, the conversion controller changes a current external input of the video providing device into an external input for the electronic device and transmits a request signal for re-operating the electronic device to the remote control signal converting device.

25. The system as claimed in claim 24, wherein, if the re-transmitter receives the request signal for re-operating the electronic device from the remote control signal converting device, the re-transmitter transmits a radio control signal corresponding to the request signal to the remote control signal converting device.

26. The system as claimed in claim 4, wherein the re-transmitter comprises:

a signal receiving module for receiving a radio control signal including the infrared channel data from the remote control signal converting device;

a signal re-transmission controller for sequentially generating radio control signals including commands according to a macro command if the radio control signal, which includes the infrared channel data, received through the signal receiving module is a signal for executing the macro command; and a signal re-transmitting module for generating an infrared channel according to the infrared channel data included in the radio control signal output from the signal re-transmission controller and re-transmitting the radio control signal to a destination electronic device through the infrared channel.

27. The system as claimed in claim 26, wherein the signal receiving module includes an infrared signal receiving module which receives the radio control signal transmitted thereto through infrared communication from the remote control signal converting device.

28. The system as claimed in claim 26, wherein the signal receiving module includes a wireless network signal receiving module which receives the radio control signal transmitted thereto through a wireless network from the remote control signal converting device.

29. The system as claimed in claim 28, wherein the wireless network is constructed based on one of a wireless local area network (WLAN) or Bluetooth communication.

30. The system as claimed in claim 26, wherein the signal receiving module includes a wired network signal receiving module which receives the radio control signal transmitted thereto through a wired network from the remote control signal converting device.

31. The system as claimed in claim 30, wherein the wired network is constructed based on one of a power line communication (PLC) and IEEE 1394 communication.

32. The system as claimed in claim 26, further comprising a network module for transmitting/receiving the radio control signal including the infrared channel data to/from another re-transmitter having an identical structure, wherein the signal retransmission controller retransmits the radio control signal to another re-transmitter having an identical structure in a blanket area through the network module in order to transmit the radio control signal received through the signal receiving module to an electric device in a blanket area.

* * * * *